United States Patent [19]

Hempelmann et al.

[11] Patent Number: 4,580,694

[45] Date of Patent: Apr. 8, 1986

[54] SEALING MECHANISM FOR A DOUBLE-LID SEAL STRUCTURE

[75] Inventors: Wilhelm Hempelmann, Eggenstein-Leopoldshafen; Günter Waldenmeier, Karlsruhe, both of Fed. Rep. of Germany

[73] Assignee: Kernforschungszentrum Karlsruhe GmbH, Karlsruhe, Fed. Rep. of Germany

[21] Appl. No.: 713,315

[22] Filed: Mar. 18, 1985

[30] Foreign Application Priority Data

Jul. 14, 1984 [DE] Fed. Rep. of Germany ..... 3425979

[51] Int. Cl.[4] ..... B65P 51/18

[52] U.S. Cl. ..... 220/256; 220/378

[58] Field of Search ..... 220/256, 323, 378, 315, 220/234, 314, 316

[56] References Cited

U.S. PATENT DOCUMENTS 4,055,274 10/1977 Waldenmeier et al. ..... 220/256

4,201,310 5/1980 Glachet ..... 220/256

*Primary Examiner*—George T. Hall

[57] ABSTRACT

A seal structure for a double-lid system with an upper lid (chamber lid) for closing the opening of a first container (chamber) and a lower lid (drum lid) for closing the opening of a second container (drum), whereby the chamber lid is provided with a surrounding seal (chamber lid seal) and the corresponding opening of the drum is also provided with a circumferential seal (drum seal), the sealing mechanism being operable in such a way that the chamber lid seal and the drum seal fully retain their sealing capability with respect to both the chamber flange and the rim of the drum lid during all operations. To this end it is suggested that at least one of the two seals, preferably the drum seal, be provided with a closed annular cavity providing an air cushion at its radially inner end.

4 Claims, 3 Drawing Figures

SEALING MECHANISM FOR A DOUBLE-LID SEAL STRUCTURE

BACKGROUND OF THE INVENTION

The invention relates to a sealing mechanism for a double-lid system allowing a contamination-free transfer of radioactive or toxic substances from one container to another.

A double-lid system of this type is presented and described in German Pat. No. 20 47 538. As shown therein, a drum is initially pressed against the chamber flange in such a manner that simultaneously the flange-type seal of the drum is engaged with the flange of the chamber and the outer rim of the drum lid is engaged with the chamber lid seal. The drum lid and the chamber lid are then coupled together and the locking mechanism of the drum lid is released. The chamber lid and drum lid can then be lifted as a unit and brought into the chamber, allowing the transfer of substances from the chamber to the drum or vice versa. After completion of the transfer, the chamber and drum are both sealed and the chamber lid and drum lid are separated from each other. The purpose of this system is, above all, to prevent the chamber and drum lid outer surfaces, which are exposed to the atmosphere, from becoming contaminated in the process. Thus, the chamber seal and the drum seal must each carry out two different functions. Their radially outer regions should be engaged with the inner and outer surfaces, respectively, of the chamber flange; at the same time, their radially inner regions should hold the rim of the drum lid firmly between them. Problems, due, for example, to tolerances, may arise however. If the rim of the drum lid is somewhat too thick, the chamber flange seal will be impaired; if it is somewhat too thin, it will not be pressed against the seals sufficiently and will not seal properly.

The object of the invention is to improve the sealing machine of this kind of double-lid system in such a way that the chamber lid seal and the drum seal fully retain their sealing capability with respect to both the chamber flange and the rim of the drum lid during all operations, in spite of the occurrence of geometric or material deviations (tolerances) of the interacting parts.

SUMMARY OF THE INVENTION

In a seal structure for a double-lid seal system associated with a containment for handling toxic materials and a drum adapted to be mounted thereon for transferring toxic materials between the containment and the drum, a first seal member is disposed on said containment around an opening therein and a second seal member is disposed on a rim of said drum and extending around the opening in the drum. The containment opening has a containment lid engaging the first seal member from within and the drum has a lid engaging the associated second seal from without and also abutting the first seal when the drum is mounted to said containment. Means are provided for selectively engaging the drum lid with the drum or with the containment lid in such a manner that any space between the containment lid and the drum lid is sealed to prevent contamination of their outer surfaces. The second seal member has an annular closed gas chamber formed therein adjacent the drum lid rim so as to provide resiliency for safe sealing engagement with the drum lid. In order to accommodate the rim of the drum lid, the drum seal is preferably provided with a recess somewhat shallower than the thickness of the rim of the drum lid. This allows the radially inner region of the drum seal abutting the rim of the drum lid to be compressed to a greater extent than the radially outer region, both regions, however, having approximately the same attainable sealing force. Variations in the thickness of the rim of the drum lid or in the elasticity of the seals can thereby be accommodated without impairing proper operation of the seal.

SHORT DESCRIPTION OF THE DRAWINGS

DESCRIPTION OF A PREFERRED EMBODIMENT

Figure 1:
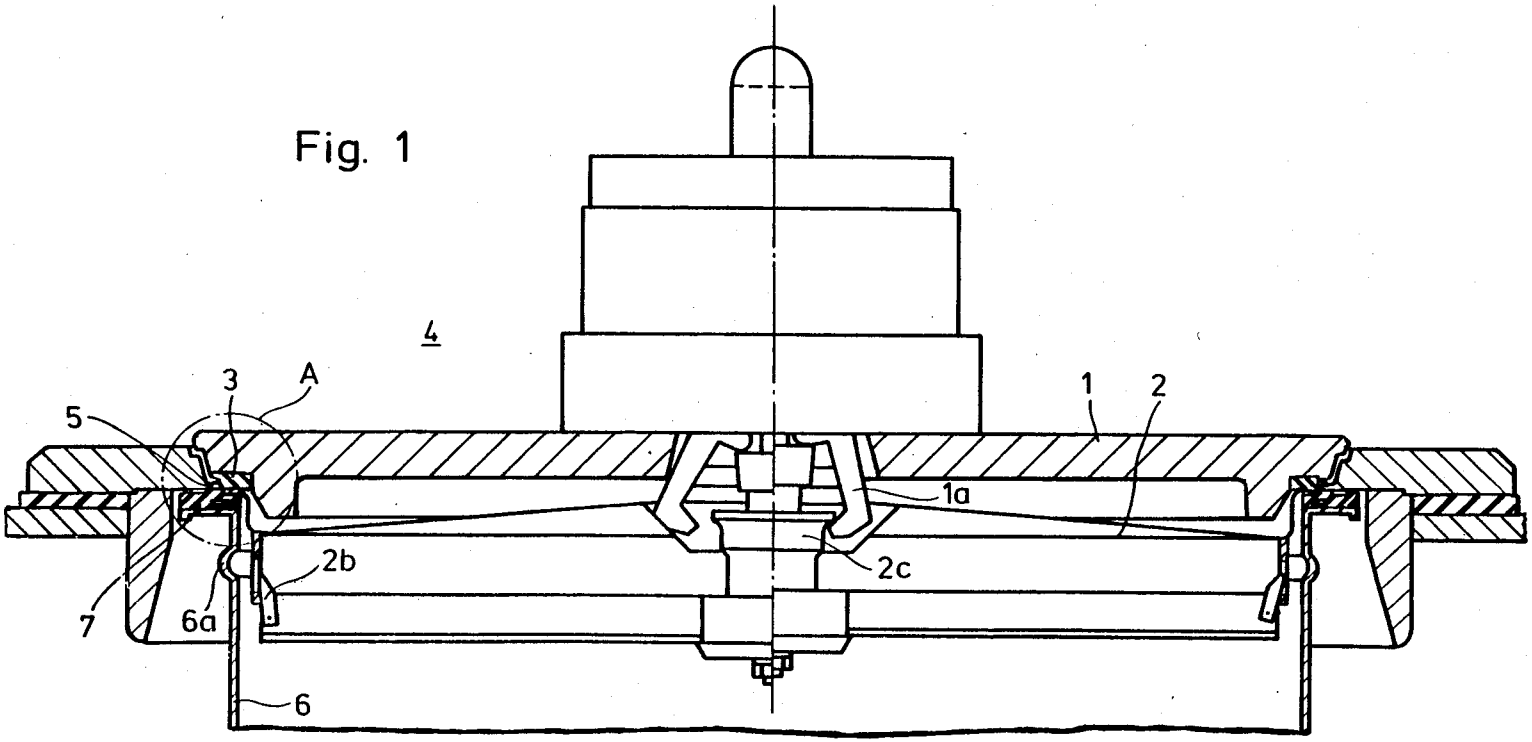
FIG. 1 is a partially sectional view of a double-lid system for transferring radioactive substances between a drum and an airtight chamber.

As shown in FIG. 1, the double-lid system comprises essentially a chamber lid 1 and a drum lid 2, which constitute the upper and lower lids, respectively. The chamber lid 1 is provided at its circumference with a chamber lid seal 3, of which the radially outer region 3*a* (FIG. 2) rests on a sealing surface 5*a* of the flange 5 which encloses the chamber opening, said sealing surface being situated in the interior of the chamber. At its opening the drum 6 is provided with a flange-type drum seal 7, of which the radially outer region 7*a* is biased against the chamber flange 5 sealing surface 5*b* situated outside the chamber 4. The outer rim 2*a* of the drum lid 2 is engaged between the radially inner region 3*b* of the chamber lid seal 3 and the radially inner region 7*b* of the drum seal 7. A locking piece 2*b* of the drum lid 2 is unlatched from a fastening groove 6*a* of the drum 6 in the position shown. A grabbing hook 1*a* of the chamber lid 1 is adapted to simultaneously grab a knob 2*c* of the drum lid 2 for pulling it toward the chamber lid 1, thereby causing the rim 2*a* of the drum lid 2 to abut the inner region 3*b* of the chamber lid seal 3.

Figure 2:
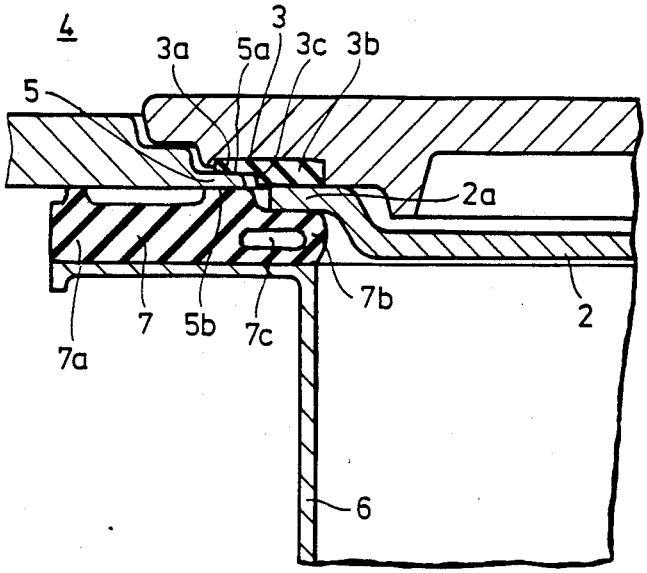
FIG. 2 shows an enlargement of detail A of FIG. 1.

FIG. 2 shows further that the radially inner region 7*b* of the drum seal 7 with the rim 2*a* of the drum lid disposed thereon is provided with a closed annular cavity 7*c* providing an air cushion with oval cross-section. The inner region 3*b* of the chamber lid seal 3 has a recess 3*c* of a depth corresponding to the thickness of the chamber flange 5.

Figure 3:
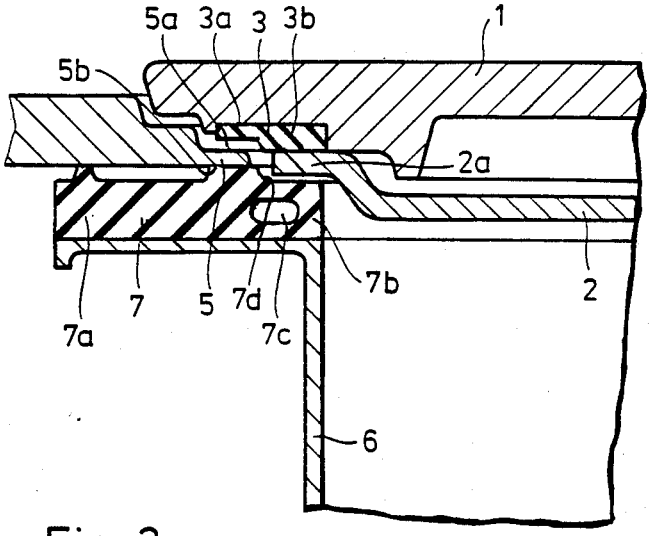
FIG. 3 shows detail A just before the chamber lid and drum lid are placed on the chamber flange and the drum seal, respectively.

As can be seen from FIG. 3, the region 7*b* of the drum seal 7 accommodate the rim 2*a* of the drum lid 2 in an annular recess 7*d* of a depth somewhat smaller than the thickness of the rim 2*a* of the drum lid 2.

As the chamber lid 1 and the drum lid 2 are together lowered into place (see FIG. 3), the rim 2*a* of the drum lid 2 first contacts the region 7*b* of the drum seal 7, this region having a greater elasticity due to the air cushion 7*c*. Further lowering of the lids compress the seal region 7*b* (FIG. 2) until the region 3*a* of the chamber lid seal 3 abuts the sealing surface 5*a* of the flange 5. The drum lid 2 can then be secured to the drum 6 by the locking piece 2*b* in the known manner and released from the chamber lid 1 by unlatching the grabbing hood 1a. The sealed and locked drum 6 can then be safely separated from the chamber 4 and removed.

It is noted that, with the arrangement according to the invention, the drum lid outer surface, although being taken into a contaminated chamber when being removed from the drum, is never exposed to contamination and remains uncontaminated upon removal of the drum from the chamber.

We claim:

1. A seal structure for a double-lid seal system associated with two containments having openings adapted to be aligned and sealed together so as to permit transfer of toxic materials from one of said containments into the other, one of said lids adapted to be disposed in one of said containments having at its circumference a first seal member adapted to engage the inner surface of said one containment around said opening therein and the opening in the other of said containments having a seal rim around the opening formed therein with a second seal member disposed on said rim and adapted to sealingly engage the outer surface of said containment around said opening when forced thereagainst, said drum lid having a flange, and said first and second seal members forming at their radially inner edges an annular cavity therebetween adapted to receive the circumferential edge of said drum lid in selectively sealing engagement with at least one of said first and second seal members, and means for releasably engaging said drum lid sealingly with said first lid and means for releasably engaging said drum lid with said second containment for closure thereof, at least one of said first and second seal members having formed therein adjacent the rim of said drum lid a closed annular gas chamber providing resiliency for said seal member when engaged by said drum lid.

2. A seal structure according to claim 1, wherein said annular gas chamber is formed in said second seal between the drum lid rim and said containment seal rim.

3. A seal structure according to claim 1, wherein said annular cavity between said first and second seal members is defined by a recess formed in said second seal member, said recess having a depth which is slightly less than the thickness of the drum lid rim.

4. A seal structure according to claim 1, wherein said first containment is a chamber, said first opening is formed in the bottom wall of said chamber, and said second containment is a drum adapted to be disposed below and in engagement with the bottom wall of said chamber.

* * * * *